US009761076B2

(12) United States Patent
Huff

(10) Patent No.: US 9,761,076 B2
(45) Date of Patent: Sep. 12, 2017

(54) TURNSTILE ALLOWING EMERGENCY EXIT

(71) Applicant: INTEGRATED DESIGN LIMITED, Feltham, Middlesex (GB)

(72) Inventor: Derek Graham Huff, Feltham (GB)

(73) Assignee: INTEGRATED DESIGN LIMITED (GB)

( * ) Notice: Subject to any disclaimer, the term of this patent is extended or adjusted under 35 U.S.C. 154(b) by 0 days.

(21) Appl. No.: 15/350,367

(22) Filed: Nov. 14, 2016

(65) Prior Publication Data

US 2017/0169643 A1 Jun. 15, 2017

(30) Foreign Application Priority Data

Nov. 12, 2015 (GB) ..... 1519997.9
Jun. 21, 2016 (GB) ..... 1610775.7

(51) Int. Cl.
*G07C 9/02* (2006.01)

(52) U.S. Cl.
CPC ..... *G07C 9/02* (2013.01)

(58) Field of Classification Search
CPC ..... G07C 9/02; G07C 9/00031; E06B 11/08; G06K 19/07354; G06K 19/077
See application file for complete search history.

(56) References Cited

U.S. PATENT DOCUMENTS 3,169,329 A 2/1965 Powers
4,628,496 A 12/1986 Lee
5,845,692 A * 12/1998 Kellem ..... E05G 5/003 160/1
2006/0101716 A1 5/2006 Vandyck et al.
2008/0028682 A1 2/2008 Casella et al.

FOREIGN PATENT DOCUMENTS

EP 0423016 4/1991

OTHER PUBLICATIONS

Search Report—Corresponding GB Application No. 1610775.7, dated Aug. 16, 2016, 1 page.
Examination Report—Corresponding GB Application No. 1519997.9, dated Apr. 14, 2016, 6 pages.

* cited by examiner

*Primary Examiner* — Nay Tun
(74) *Attorney, Agent, or Firm* — Leber IP Law

(57) ABSTRACT

A turnstile comprising means for dictating a person entering or exiting the lane, a barrier positioned to move between a position blocking a lane and a position where it allows passage through the lane, under control of a motor; means for checking the credentials of a person attempting to pass through the lane and a brake, the turnstile having a mode of operation in which in the event that a user enters an exit side of the lane without presenting a credential, and an authorized person is not detected on the entry side of the lane, the brake is unlocked and the barrier is held in position in a closed mode but is able to be pushed or pulled by the person who has entered from the exit side in order for that person to exit; and the motor assists movement in the pushing or pulling direction by moving the barrier at a controlled speed, less than a speed at which it operates the barrier if the exiting user presents a credential.

7 Claims, 2 Drawing Sheets

TURNSTILE ALLOWING EMERGENCY EXIT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

This invention relates to a turnstile allowing an emergency exit. In particular it relates to a turnstile of the type sometimes termed as a "speedgate".

In such products panels or other mechanical barriers or obstructions are mounted on either side of a channel or lane through which persons have to pass and are mechanically moved, typically pivoting about a vertical axis, to allow persons to pass through a channel from one area to another. They thus perform the function of a turnstile. Often this is facilitated by the presentation of a credential or token such as a smartcard, finger print or similar which must be presented to a suitable reader and which, once the user's credentials have been authorised, either causes the/or each panel to open or releases a break/lock which enables the user to physically push the barriers to pass through. They may allow movement in either direction (ie for entry or exit (egress)) and passage in both or just one of the directions may require credential or token authorised entry. Sometimes the operation in either direction may be triggered by a mechanical switch or other means.

Such products therefore provide a security function to disallow unauthorised persons from entering a secure area for example.

Sometimes there is no need for the use of a credential on exit. Instead, a sensor or sensors detect the presence of a person wishing to exist and the barrier opens automatically and subsequently recloses. In some simple turnstile type systems free exit is provided by means of a directional brake which enables a user freely to pass through in the exit direction but not to pass through in the entry direction unless authorised.

In a situation where authorisation is normally required for exit there is sometimes a requirement that in an emergency egress situation it must be possible to simply push the panel away (ie in the direction allowing movement in the exit direction) in order to escape an area quickly. It is possible also to employ directional brakes, clutches and so on. However, a disadvantage of this is that if a directional brake or clutch is provided it may be possible for an unauthorised user wishing to enter to simply pull a panel or door in the exit direction and thereby facilitate unauthorised entry.

It is also possible to provide a 'crash bar' (crash) type switch (such as the "push for exit" bars seen on emergency exit doors) such that an exiting person could operate it to facilitate exit without use of a token in an emergency situation. One problem with this is that such a crash bar switch or switches need to be apparent and easily operated and there is the possibility that they may be operated by an unauthorised person from the insecure side of the passageway.

In addition, in many situations it is of course paramount that people exit as soon as possible, yet it is also important that people's movements be monitored, and that the identity and the number of people left in a space is known, so there is a need for an "emergency" exit system, or mode, which still encourages users to present credentials if possible.

The present invention therefore arose in an attempt to provide an improved system allowing free emergency exit yet still preventing unauthorised users from entering using that system.

BRIEF SUMMARY OF THE INVENTION

According to the present invention there is provided a turnstile comprising a barrier positioned to move between a position blocking or partly blocking a lane and a position where it allows passage through the lane, under control of a motor; means for checking the credentials of a person attempting to pass through the lane and a brake, the turnstile having a mode of operation in which in the event that a user enters an exit side of the lane without presenting a credential, and an authorised person is not detected on the entry side of the lane, the brake is unlocked and the barrier is held in position in a closed mode but is able to be pushed or pulled by the person who has entered from the exit side in order for that person to exit; and the motor assists movement in the pushing or pulling direction by moving the barrier at a controlled speed which may be less than the speed at which it operates the barrier if the exiting user presents a credential.

A "crash bar" type switch is preferably included, the operation of which, to open or unlock the barriers is only enabled if no unauthorised person is detected attempting to enter.

In a further aspect, the invention provides an access control means having a barrier which is released to facilitate emergency unauthorised exist provided entry is not in process.

The mode of operation might be "forced exit" mode, perhaps instigated by an alarm condition been set by an operator (local or remote of an external alarm sensing system (eg fire alarm), or otherwise.

Preferably, electrical and/or optical sensing means are used to detect entry and/or exit and this may be by means of a row or an array of optical sensors, typically infrared sensors, arranged to monitor the passage of a person.

By keeping the barrier closed and using the motor to slowly open the barrier when pushed or pulled at a predetermined speed, eg a slower speed than the speed when a credential is entered, a degree of "delay" or "inconvenience" is obtained. This can be avoided by a user presenting his credentials (if he or she has time) which can cause the barrier to open at a speed faster than the speed of the forced exit mode described above. Thus, unless it is a severe emergency, users may still present credentials if they wish to avoid delay, enabling the system to monitor movements and populations in secured and/or unsecured areas.

Embodiments of the invention will now be described, by way of example only, with reference to the accompanying schematic drawings in which;

DETAILED DESCRIPTION OF THE INVENTION

Figure 1:
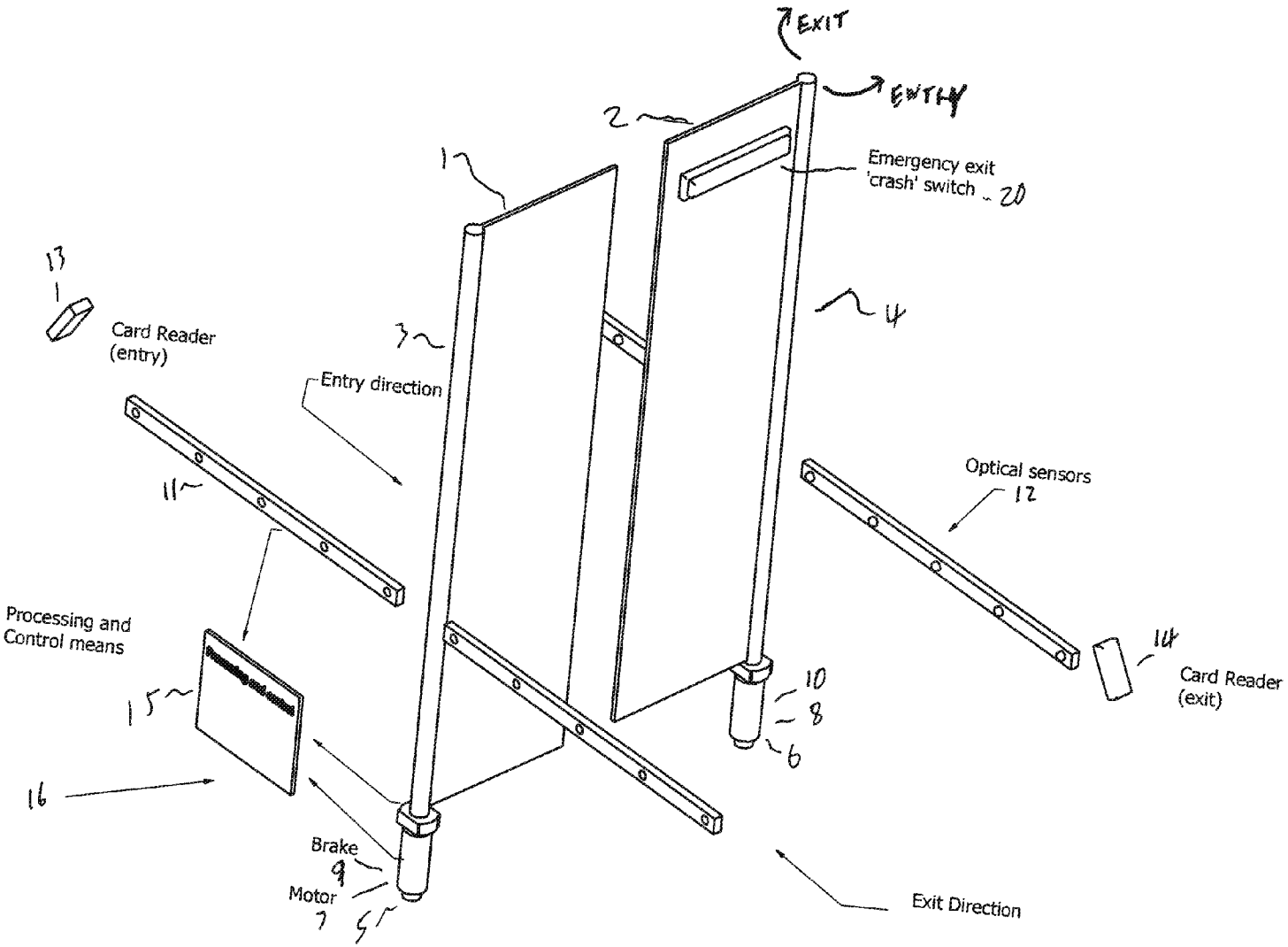
FIG. 1 shows an access control system in a closed disposition.

Referring to FIG. 1, an access control system of the turnstile or "speedgate" type comprises a pair of gates 1, 2 mounted on respective pillars 3, 4, each supported by a respective support 5, 6, which mounts a motor 7, 8 and a brake/lock 9, 10 respectively. Details of these are not shown but are well known in this environment. These can be used to rotate the gates either in a clockwise or anti-clockwise direction such that they can be rotated in one direction to open the passage for entry and in another direction to open the passage for exit. The brakes/locks may also be applied to restrict movement in one or both directions.

The apparatus also includes sensing means, such as an array (or a single row) of sensors and detectors, such as optical sensors and/or transmitters 11, 12 on respective sides of the passageway. Other types of sensors and detectors may be used. Note that "optical" does not necessarily mean in the visible spectrum. They will typically be IR sensors and detectors.

These may comprise transmitters on one side of the passageway and sensors on the other, or both sides may have sensors and transmitters. These may be infrared transmitters for example which transmit beams which are sensed by the sensors 12 such that a breaking of the beams indicates that something or someone is passing through. Software is used to determine the direction of passage and other information, as is well known. It may also be used to stop tailgating and only allow one person at a time through. The apparatus may also be provided with respective card readers 13, 14 which may read an authorisation card such as a smartcard by the user, and determines whether the user is entitled to enter or exit. Note that there need not be authorisation checking, or this may be provided just in the entry direction. Instead of a card reader other suitable authorisation means may be provided, either additionally or alternatively, such as retina sensors, fingerprint sensors or other types of authorisation means.

The card readers 13, 14 and optical transmission/sensing apparatus 11, 12 are connected to a central processing and control means 15 which also controls the motors 7, 8 and brakes 9,10. This might also receive input 16 from a remote access control station.

Optionally, one or both gates may be provided with an emergency exit "crash" switch 20. This may be a similar construction to emergency exit crash switches which are often applied to regular emergency exit doors and which when depressed can cause (or unlock/enable) a door to open. This may be useful in emergency situation for a user wishing to exit to indicate their desire to exit quickly. Depression of this switch may cause the locks to unlock (if no unauthorised entry is detected), or, if already unlocked, may cause the barrier to open under control of the motor, or to be opened manually.

Figure 2:
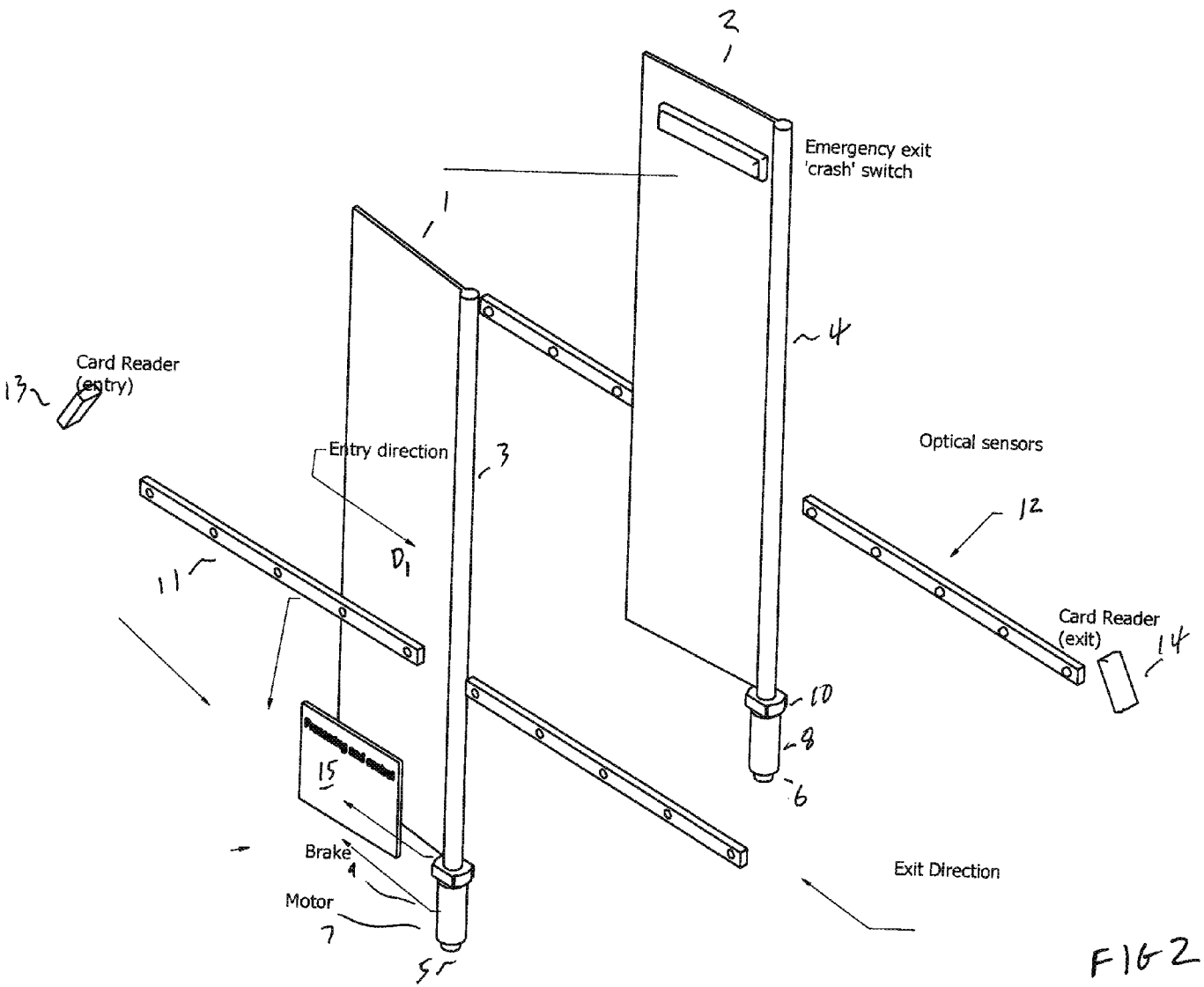
FIG. 2 shows the access control system in an emergency exit disposition.

FIG. 2 shows the system of FIG. 1 in a disposition in which the doors have been opened to allow exit. They thus hinge away from a person who is moving in the exit direction. Clearly, if the person is entering instead then the doors would be hinged the other way.

The brakes 9, 10 can prevent the panels from moving. The control unit 15 monitors the optical system and provides processing means to control the brakes and motor.

In embodiments, the apparatus monitors any attempts to enter in the entry direction D1 (by using the optical sensing means 11, 12) and may also monitors whether such attempts for entry are authorised, by means of presenting suitable identification at the card reader 13 for example. When an authorised attempt at entry in the entry direction is not in process and a person attempts to exit (eg is detected to exit) then the brake/lock in the exit direction, if applied, is unlocked. That person can then push or pull the gates (in the exit direction) to open. The motor then assists the user by opening the barrier in the described direction. Typically this will be at a slower speed than a regular speed by which the barrier is automatically opened when an existing user presents credentials or a security officer causes the barrier to open remotely, for example.

In embodiments, the turnstile may have a "Forced Exit Mode". This mode will be enabled by a dip switch on the Fastlane (RTM) processor, or by a signal from a security officer, or otherwise.

In the event that a user enters the exit side of the lane without presenting a card or other credential, the exit side optical system reports a warning using the exit side indicator board (red flashing indicator and beep sounder).

If a user is not detected on the entry side of the lane, the brakes unlock.

The barriers are then held in position by the motor driver system. The user can then push (or pull) the barriers, when the barriers are pushed, the motor will assist the user by slowly opening the barriers in the exit direction.

A second stage alarm may be asserted for the person/s exiting. When the user has cleared the optical system the barrier close and locks, unless other users are detected in the lane in which case the barriers remain open until the optical system does not detect users. The second stage alarm will be activated for each person exiting in forced exit mode.

Further examples/scenarios may be as follows:

A. In normal use a person presents a credential to enter or exit. When validation is provided the brake is de-energised and the motor moves the panel to allow entry or exit and the monitoring means monitors that person and can detect if more than one person uses the lane or is moving in the wrong direction. This is normal operation.

B. If a person enters the lane in an entering direction without an authorising signal having been provided the brake/lock will remain locked.

C. In the event that a person enters the lane in an exiting direction and there is no person detected entering on the entering side of the lane then the brake/lock is released but the panel does not move automatically. This may be an alarm condition and enables a person, when no unauthorised person is attempting to enter, to freely exit. This may only occur if the person detected entering on the entering side has not been authorised by presentation of suitable credentials, for example.

D. When condition C above exists it is possible for the exiting person to push the panel open and proceed to exit. The motors assist the opening movement and can delay this by moving the barrier at a predetermined speed. This may be an alarm condition. The panels may then return to a closed position under action of the motors.

E. Any or all of the above conditions or states may be signalled eg audibly or electronically by suitable equipment (not shown).

In the above manner it is possible to provide enhanced security for emergency egress whilst still preventing an unauthorised person from gaining unauthorised entry without the knowledge and/or collusion of an exiting person.

The apparatus may include a feature such that when a user has passed through a lane (cleared the lane), if other users are detected in the lane (and, in some embodiments, only if they are detected moving in a specific direction, eg the "exit" direction), the barrier remains open until further users are not detected moving in that direction, whereas if, when the first user has cleared the lane, no person is detected (or no person is detected moving in the specific direction), then the barrier closes and is locked.

Other biometric sensors, beyond fingerprint sensors or retina scanners, may be employed in embodiments of the invention.

The invention claimed is:

1. A turnstile comprising means for detecting persons, entering or exiting a lane, a barrier positioned to move between a position blocking a lane and a position where the barrier allows passage through the lane, under control of a motor; means for checking authorization of a person attempting to pass through the lane and a brake, the turnstile having a mode of operation in which in the event that a user enters an exit side of the lane without presenting authorization, and an authorized person is not detected on an entry side of the lane, the brake is unlocked and the barrier is held in position in a closed mode but is able to be pushed or pulled by the user who has entered from the exit side in order for the user to exit; and the motor assists movement in a direction of pushing or pulling by the user entering from the exit side by moving the barrier at a controlled speed, less than a speed at which the motor operates the barrier if the exiting user presents authorization.

2. The turnstile as claimed in claim 1 including a crash type emergency access switch which is actuatable to cause the barrier to unlock.

3. The turnstile as claimed in claim 2 wherein the crash type emergency access switch is only enabled when no unauthorized person is detected attempting to exit.

4. The turnstile as claimed in claim 1 wherein entry and/or exit of a user is determined by electrical and/or optical transmitting and sensing means.

5. The turnstile as claimed in claim 4 wherein the means comprises a row or array of optical transmitters and sensors.

6. The turnstile as claimed in claim 1 wherein the means for checking authorization comprises a biometric sensor.

7. The turnstile as claimed in claim 6 wherein the biometric sensor is a fingerprint sensor or retina scanner.

* * * * *